US011505897B2

(12) United States Patent
Martikainen et al.

(10) Patent No.: US 11,505,897 B2
(45) Date of Patent: Nov. 22, 2022

(54) INDUSTRIAL TEXTILE FOR MANUFACTURING A FIBROUS WEB

(71) Applicant: Valmet Technologies Oy, Espoo (FI)

(72) Inventors: Hannu Martikainen, Espoo (FI); Tania Rautio, Espoo (FI); Mari Seppänen, Espoo (FI); Seppo Taipale, Espoo (FI)

(73) Assignee: VALMET TECHNOLOGIES OY, Espoo (FI)

( * ) Notice: Subject to any disclaimer, the term of this patent is extended or adjusted under 35 U.S.C. 154(b) by 69 days.

(21) Appl. No.: 17/338,471

(22) Filed: Jun. 3, 2021

(65) Prior Publication Data

US 2021/0381165 A1 Dec. 9, 2021

(30) Foreign Application Priority Data

Jun. 4, 2020 (FI) ..... 20205583

(51) Int. Cl.
*D21F 7/08* (2006.01)
*D03D 13/00* (2006.01)
*D21F 1/00* (2006.01)

(52) U.S. Cl.
CPC ..... *D21F 1/0036* (2013.01); *D03D 13/004* (2013.01)

(58) Field of Classification Search
CPC ..... D21F 1/0036; D21F 1/0045; D21F 1/10; D21F 7/10; D03D 13/004; D03D 11/00; D03D 13/00; D03D 21/00; D03D 15/00; D10B 2505/00
See application file for complete search history.

(56) References Cited

U.S. PATENT DOCUMENTS 4,041,989 A * 8/1977 Johansson ..... D21F 1/0036 162/903
4,501,303 A * 2/1985 Osterberg ..... D21F 1/0045 428/221
4,917,937 A * 4/1990 Lappanen ..... D21F 1/30 428/196

(Continued)

FOREIGN PATENT DOCUMENTS

EP 1724382 A1 11/2006
EP 2194186 A1 6/2010

(Continued)

OTHER PUBLICATIONS

Finnish Search Report for FI 20205583 dated Dec. 4, 2020.

*Primary Examiner* — Robert H Muromoto, Jr.
(74) *Attorney, Agent, or Firm* — Stiennon & Stiennon

(57) ABSTRACT

An industrial textile (6) for manufacturing a fibrous web has first machine direction yarns (1) on the front side (7) which bind to first cross-machine direction yarns (4) in a first pattern, while second machine direction yarns (2) on the back side bind to second cross-machine direction yarns (5) in a second pattern. Third machine direction yarns (3) bind to the first cross-machine direction yarns (4) and the second cross-machine direction yarns (5) in a third pattern. The third pattern has at least one interlacing point (71) on the front side where one of the third machine direction yarns (3) passes over one of the first cross-machine direction yarns (4) and at least one interlacing point (72) on the back side (8) where the same third machine direction yarn (3) passes under one of the second cross-machine direction yarns (5).

20 Claims, 10 Drawing Sheets

(56) References Cited

U.S. PATENT DOCUMENTS 4,974,642 A * 12/1990 Taipale ..... D21F 1/0036 139/410
5,518,042 A * 5/1996 Wilson ..... D21F 1/0027 139/383 A
5,571,590 A * 11/1996 Schultz ..... D21F 1/0054 156/73.2
5,785,621 A * 7/1998 Birzele ..... D21F 1/0045 474/267
5,826,627 A * 10/1998 Seabrook ..... D21F 1/0045 162/903
5,967,195 A * 10/1999 Ward ..... D21F 1/0045 139/383 A
6,240,973 B1 * 6/2001 Stone ..... D21F 1/0045 162/903
6,508,278 B1 * 1/2003 Kornett ..... D03D 3/04 139/415
6,581,645 B1 * 6/2003 Johnson ..... D21F 1/0036 139/384 R
10,633,793 B2 * 4/2020 Enqvist ..... D21F 1/0027
2003/0060109 A1 * 3/2003 Joyce ..... D21F 7/086 442/181
2006/0249220 A1 * 11/2006 Barrett ..... D21F 1/0045 139/383 A
2007/0095417 A1 * 5/2007 Fujisawa ..... D21F 1/0036 139/383 A
2007/0151617 A1 * 7/2007 Fahrer ..... D21F 1/0045 139/383 A
2009/0090425 A1 * 4/2009 Hawes ..... D21F 7/083 139/383 AA
2011/0030909 A1 * 2/2011 Danby ..... D21F 1/0045 162/358.2
2013/0327490 A1 * 12/2013 Taipale ..... D21F 7/083 162/289
2017/0314199 A1 * 11/2017 Despault ..... D21F 1/0036
2018/0355555 A1 * 12/2018 Taipale ..... D21F 1/0045
2021/0381165 A1 * 12/2021 Martikainen ..... D21F 1/0036
2022/0195642 A1 * 6/2022 Martikainen ..... D21F 1/0045

FOREIGN PATENT DOCUMENTS

JP 1743780 B2 8/2011
JP 2017089022 A 5/2017

* cited by examiner

INDUSTRIAL TEXTILE FOR MANUFACTURING A FIBROUS WEB

CROSS REFERENCES TO RELATED APPLICATIONS

This application claims priority on Finnish Application No. FI 20205583, filed Jun. 4, 2020, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to an industrial textile for manufacturing a fibrous web.

Two-layer paper machine fabric structures, or double-layer wires, are widely known in the field. These structures have one warp system and two weft systems. The technology of a double-layer paper machine fabric has been described in U.S. Pat. No. 4,041,989, for instance. Owing to the single warp system, the wires are thin, but also susceptible to breaking. As the dewatering elements of the paper machine wear down the fabric on the wear side, all yarns in the warp direction also wear down, and the risk of the fabric breaking increases. In addition, the wear on the yarns makes the fabric unstable, which degrades the paper profiles.

Also known in the field are so called machine direction binding (MDB) paper machine fabrics. In those structures binding warp yarn interweaves on the machine side to the bottom cross-machine direction yarn and on the paper side to the top cross-machine direction yarn. This binding warp yarn replaces the paper side warp yarn in the interlacing point. Usually there is one interlacing point in the weave pattern repeat.

SSB structures are also known in the field. SSB is an acronym for sheet support binding. These structures have two warp systems and three weft systems. One of the weft systems consists of binding yarn pairs that bind the paper-side and wear-side layers together and also participate in forming the paper-side layer. The art of SSB structures is described in the U.S. Pat. Nos. 4,501,303; 5,967,195 and 5,826,627, for instance. Due to the two warp systems, SSB structures achieve greater wear resistance and improved stability, compared to double-layer structures.

In SSB structures, the top weft, on both sides of the intersection of the binding yarns, presses down the top warp yarns at the intersection; at the same time, both yarns in the binding yarn pair descend inside the fabric and do not support the top warp yarns from below. As a result, the intersections remain under the surface of the wire, which may cause markings. This has been described in U.S. Pat. No. 5,967,195, for instance.

Internal wear occurs in SSB structures. Internal wear occurs when the paper-side and the wear-side layers are not connected to each other closely enough, which results in the layers rubbing against each other. In SSB structures, internal wear especially occurs in the intersections of the binding yarns. The movement of the paper side and wear side against each other causes wear on the warp or weft yarns above and below the intersection of the binding yarns. The wear changes the overlap of the layers in the direction of the warp and the permeability of the paper machine fabric deteriorates considerably. The wear may be uneven, which means that the overlap of warp threads may vary over the width of the machine, causing profile issues in the paper.

In SSB structures, the layers are bound together with binding yarn pairs. This means that two binding weft threads are required to form one continuous weft path on the front side of the fabric. For this reason, the weft density becomes quite high in denser structures. As a result, more material is needed to manufacture the product, it is slower to weave and it becomes more expensive to manufacture.

Passing between the top and bottom warps, the binding yarn pairs in SSB structures also increase the thickness of the wire. The thickness of the paper machine fabric becomes a problem for certain types of fast paper machines.

SUMMARY OF THE INVENTION

An object of the present invention is to provide an industrial textile so as to overcome the above problems.

The industrial textile has many advantages. The technical features behind the advantages enhance the runnability of the industrial textile.

The industrial textile is dimensionally stabile both in the machine direction and the cross-machine direction. The industrial textile is dimensionally stabile. The edges of the industrial textile are straight in such a manner that they do not curl up. This is important because the straight edges assist in forming an even paper or board web throughout the whole width direction of the web. Further, web breaks may be avoided because there are no problems in cutting the paper or board web due to the curled edges.

Water permeability of the industrial textile is even both in the machine direction and the cross-machine direction. Since the internal wear of the industrial textile is minor there are only minor differences in the water permeability.

The industrial textile is also thin. It holds less liquid inside it compared to thicker textiles.

The service life of the industrial textile is long due to the structure of the back side of the industrial textile.

The front side of the industrial textile is even and smooth. Thus, marking of the paper or board web is prevented.

A term "offset" is used in this text. Adjacent machine direction yarns of the same system, i.e., first machine direction yarns, second machine direction yarns or third direction yarns, have the same binding but in a different place. For example, if a certain machine direction yarn has an interlacing point with a certain cross-machine direction yarn an adjacent machine direction yarn has a corresponding interlacing point with a cross-machine direction yarn that has a number counted from the certain cross-machine direction yarn. For example, if a machine direction yarn has an interlacing point with a certain cross-machine direction yarn and an adjacent machine direction yarn has a corresponding interlacing point with the first cross-machine direction yarn counted from the certain cross-machine yarn there is an offset of ±1. If the offset extends from the bottom left to the top right the offset is positive but if it extends from the bottom right to the top left the offset is negative.

A term "pattern" is used in this text. The pattern is a minimum unit that is repeated over the industrial textile. The pattern may be a weave pattern repeat but the pattern also applies to other techniques. The industrial textile is for manufacturing a fibrous web. The industrial textile is mainly used on a paper or a board machine.

The industrial textile has a front side and a back side. The front side is configured to be in contact with a paper web or the like and the back side is a machine side. The industrial textile comprises at least three machine direction yarn systems and at least two cross-machine direction yarn systems. The machine direction yarn systems may be warps and the cross-machine direction yarns may be wefts. The industrial textile may be manufactured by weaving.

The industrial textile comprises first machine direction yarns, second machine direction yarns and third machine direction yarns. The first machine direction yarns are on the paper side yarn layer and the second machine direction yarns are on the machine side layer. The third machine direction yarns interweave the paper side yarn layer and the machine side yarn layer together. The third machine direction yarns also participate in forming the paper side yarn layer and the machine side yarn layer.

The industrial textile comprises first cross-machine direction yarns and second cross-machine direction yarns. The first machine direction yarns, the third machine direction yarns and the first cross-machine direction yarns are configured to form the front side of the industrial textile. The first machine direction yarns and the third machine direction yarns extend side by side on the front side of the industrial textile. The third machine direction yarns are an integral part in forming the front side of the industrial textile, i.e., the bind of the front side is incomplete without the third machine direction yarns. The second machine direction yarns, the third machine direction yarns and the second cross-machine direction yarns are configured to from the back side of the industrial textile. The second machine direction yarns and the third machine direction yarns extend side by side on the back side of the industrial textile. The third machine direction yarns are also an integral part in forming the back side of the industrial textile, i.e., the bind of the back side is incomplete without the third machine direction yarns.

In addition to the above-mentioned cross-machine direction yarns the industrial textile may comprise additional cross-machine direction yarns on either or both sides of the industrial textile.

The third machine direction yarns are configured to interweave the front side and the back side of the industrial textile together. The first machine direction yarns and the first cross-machine direction yarns bind according to a first pattern. The second machine direction yarns and the second cross-machine direction yarns bind according to a second pattern. The third machine direction yarns, the first cross-machine direction yarns and the second cross-machine direction yarns bind according to a third pattern. The second pattern is the largest of the patterns and therefore, the second pattern determines the size of the whole pattern comprising the first machine direction yarns, the second machine direction yarns, the third machine direction yarns, the first cross-machine direction yarns and the second cross-machine direction yarns.

A third machine direction yarn is configured to pass over one of the first cross-machine direction yarns on the front side of the industrial textile. Said third machine direction yarn is also configured to pass under the preceding first cross-machine direction yarn and under the following first cross-machine direction yarn. A first machine direction yarn, which is adjacent to the third machine direction yarn, is configured to pass over the same first cross-machine direction yarn as the third machine direction yarn on the front side of the industrial textile. Said first machine direction yarn is also configured to pass under the preceding first cross-machine direction yarn and under the following first cross-machine direction yarn. Thus, the third machine direction yarn and the first machine direction yarn have a common interlacing point on the front side of the industrial textile where both machine direction yarns pass under and over successive first cross-machine direction yarns in the following order: Under one first cross-machine direction yarn, over the following first cross-machine direction yarn and under the next first cross-machine direction yarn. The common interlacing point appears at least twice within the second pattern.

Further, a third machine direction yarn may be configured to pass under one of the second cross-machine direction yarns on the back side of the industrial textile. Said third machine direction yarn is also configured to pass over the preceding second cross-machine direction yarn and over the following second cross-machine direction yarn. A second machine direction yarn, which may be adjacent to the third machine direction yarn or in the vicinity of the third machine direction yarn, may be configured to pass under the same second cross-machine direction yarn as the third machine direction yarn on the back side of the industrial textile. Said second machine direction yarn is also configured to pass over the preceding second cross-machine direction yarn and over the following second cross-machine direction yarn. Thus, the third machine direction yarn and the second machine direction yarn may have a common interlacing point on the back side of the industrial textile where both machine direction yarns pass under and over successive second cross-machine direction yarns in the following order: Over one second cross-machine direction yarn, under the following second cross-machine direction yarn and over the next second cross-machine direction yarn.

When a second machine direction yarn is in the vicinity of the third machine direction yarn there is at least one machine direction yarn between the second machine direction yarn and the third machine direction yarn. There may be one second machine direction yarn and one third machine direction yarn between those particular yarns, for example.

The above-mentioned structure comprises the following advantages: In some cases, the marking of the paper or board web is prevented with the above-mentioned structure since the path of the first machine direction yarn does not change at the common interlacing point on the paper side, i.e., the first pattern remains unchanged.

Compared to structures that have the binding yarn pair the above-mentioned structure is more cost-effective to produce because there is only the first cross-machine direction yarn instead of the binding yarn pair. Thus, only one beat is required instead of two.

The edges of the industrial textile are straight in such a manner that they do not curl up. The strain of the machine direction yarns is substantially even, i.e., each system of the machine direction yarns has substantially the same strain. Further, it is possible to avoid certain materials, such as polyarnide, which is prone to curl up.

Usually, the thickness of the industrial textile may be reduced e.g., by using thinner cross-machine direction yarns. In the above-mentioned structure it is also possible to reduce the thickness by binding the layers of the industrial textile tightly together so that there is less space for liquid inside the industrial textile. This is important because liquid may cause web breaks on a paper machine and removing of liquid increases energy costs.

The industrial textile is dimensionally stabile both in the machine direction and the cross-machine direction due the common interlacing points on the front side of the industrial textile. The first cross-machine direction yarns are locked in their place in the common interlacing points on the front side of the industrial textile. Thus, it is possible that the first cross-machine direction yarns have long floats on the front side of the industrial textile.

Since the third machine direction yarns and the second machine direction yarn may have common interlacing points on the back side of the industrial textile the stability of the industrial textile may be further increased.

In the above-mentioned structure the second machine direction yarns bind to the second cross-machine direction yarns, thus forming the back side of the industrial textile. The second machine direction yarns are substantially straight in the structure and therefore, the industrial textile is less prone to stretch. As stretching causes narrowing also narrowing is under control in the above-mentioned structure.

The internal wear of the industrial textile is minor since the front side and the back side are tightly bound together, i.e., the layers cannot rub to each other. This is an important advantage because an uneven water permeability may follow from the internal wear.

Each group of the yarns, namely the first machine direction yarns, the second machine direction yarns, the third machine direction yarns, the first cross-machine direction yarns and the second cross-machine direction yarns, may be of different thickness, or some of them may be of the same thickness. On the one hand, as the front side of the industrial textile may be formed of thinner yarns marking of a paper or board web becomes less. On the other hand, as the back side of the industrial textile may be formed of thicker yarns, the service life of the industrial textile is increased.

The yarns of the industrial textile may be monofilaments but multi-filaments are also possible. The cross-section of the yarns may be any, such as round, square, rectangular, or oval. The machine direction yarns preferably have square cross-sections. The cross-machine direction yarns have preferably round cross-sections. The material of the yarns may be polyester or polyarnide yarns. Other possible yarn materials include PEN (polyethylene naphthalate) or PPS (polyphenylene sulfide). In addition to the above-mentioned man-made fibers also natural fibers or regenerated fibers can be considered. Further, recycled fibers of any of the above-mentioned fibers may be used.

The weft ratio may be, for example, 1:1, 2:1, or 3:2, i.e., the ratio of the first cross-machine direction yarns to the second cross-machine direction yarns may be one of the above-mentioned ratios. Assumed that the first machine direction yarns include in upper warps and the second machine direction yarns and the third direction yarns include in lower warps the warp ratio may be under one, for example 1:2 or 2:3, i.e., the ratio of the first machine direction yarns to the second machine direction yarns and the third machine direction yarns may be under one. The weave pattern repeat of the front side of the industrial textile preferably comprises 2 or 4 machine direction yarns. The weave pattern repeat of the back side preferably comprises 8 or 16 machine direction yarns.

The industrial textile may have a weight of 280 to 700 g/m$^2$ and a thickness of 0.5 mm to 1.2 mm. The first machine direction yarns, the second machine direction yarns and the third machine direction yarns may have square cross sections. Their dimensions may be from 0.10×0.10 mm to 0.20×0.20 mm. For example, the first machine direction yarns may have a dimension of 0.12×0.12 mm, the second machine direction yarns and the third machine direction yarns may have a dimension of 0.15×0.15 mm.

The first cross-machine direction yarns and the second cross-machine direction yarns may have round cross sections. The first cross-machine direction yarns may have a diameter of 0.10 mm to 0.15 mm. For example, the first cross-machine direction yarns may have a diameter of 0.13 mm.

The second cross-machine direction yarns may have a diameter of 0.20 to 0.50 mm. For example, the second cross-machine direction yarns may have a diameter of 0.40 mm.

BRIEF DESCRIPTION OF THE DRAWINGS

In the following the invention will be described in greater detail by means of preferred embodiments with reference to the attached drawings.

DESCRIPTION OF THE PREFERRED EMBODIMENTS

Figure 1A:
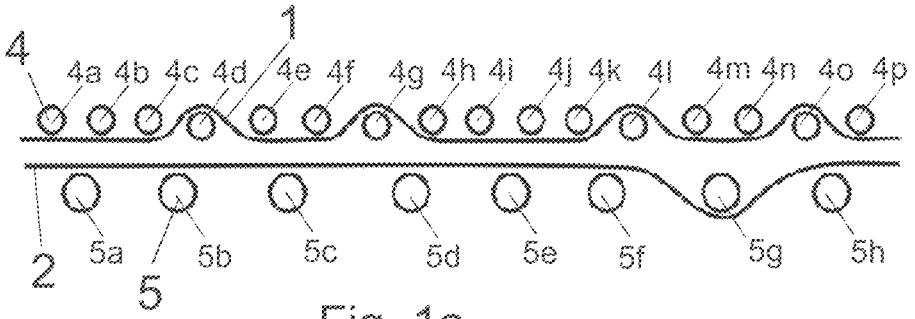
FIGS. 1*a* to 1*h* show a bind of an industrial textile.

FIGS. 1*a* to 1*h* show a bind of an industrial textile 6. The industrial textile comprises first machine direction yarns 1, second machine direction yarns 2, third machine direction yarns 3, first cross-machine direction yarns 4 and second cross-machine direction yarns 5.

The first machine direction yarns 1 and the first cross-machine direction yarns 4 form a first pattern. The first pattern has an offset of ±2. The second machine direction yarns 2 and the second cross-machine direction yarns 5 form a second pattern. The second pattern has an offset of ±5. The third machine direction yarns 3, the first cross-machine direction yarns 4 and the second cross-machine direction yarns 5 form a third pattern. The third pattern has an offset of ±5. The interlacing points on the front side of the industrial textile has an offset of ±2.

The industrial textile is bound together by the third machine direction yarns 3, the first cross-machine direction yarns 4 and the second cross-machine direction yarns 5. The third machine direction yarns 3 are an integral part of the bind on the front and back side of the industrial textile 6, i.e., the bind of the front side and the bind of the back side are incomplete without the third machine direction yarns 3.

In FIG. 1*a* a first machine direction yarn 1 repeatedly passes under three first cross-machine direction yarns 4*a*, 4*b*, 4*c*, over one first cross-machine direction yarn 4*d*, under two first cross-machine direction yarns 4*e*, 4*f*, over one first cross-machine direction yarn 4*g*, under four first cross-machine direction yarns 4*h*, 4*i*, 4*j*, 4*k*, over one first cross-machine direction yarn 4*l*, under two first cross-machine direction yarns 4*m*, 4*n*, over one first cross-machine direction yarn 4*o* and under one first cross-machine direction yarn 4*p*.

In FIG. 1*a* a second machine direction yarn 2 repeatedly passes over six second cross-machine direction yarns 5*a*, 5*b*, 5*c*, 5*d*, 5*e*, 5*f*, under one second cross-machine direction yarn 5*g* and over one second cross-machine direction yarn 5*h*.

Figure 1B:
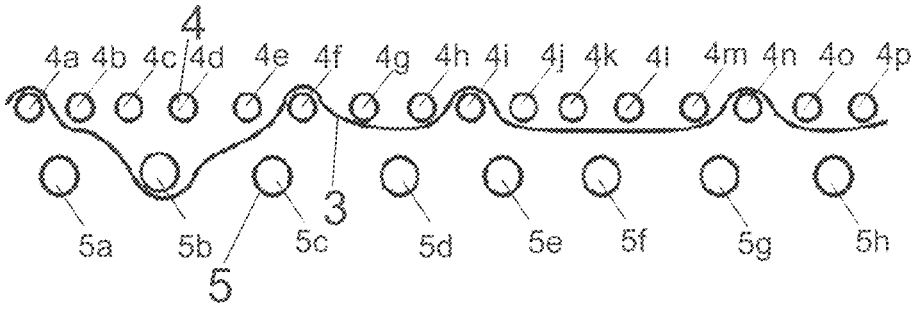

In FIG. 1*b* a third machine direction yarn 3 repeatedly passes over one first cross-machine direction yarn 4*a*, under four first cross-machine direction yarns 4*b*, 4*c*, 4*d*, 4*e*, over one first cross direction yarn 4*f*, under two first cross-machine direction yarns 4*g*, 4*h*, over one first cross-machine direction yarn 4*i*, under four first cross-machine direction yarns 4*j*, 4*k*, 41, 4*m*, over one first cross-machine direction yarn 4*n* and under two first cross-machine direction yarns 4*o*, 4*p*.

When the third machine direction yarn 3 passes under the four first cross-machine direction yarns 4*b*, 4*c*, 4*d*, 4*e* it also passes under one second cross-machine direction yarn 5*b*.

Figure 1C:
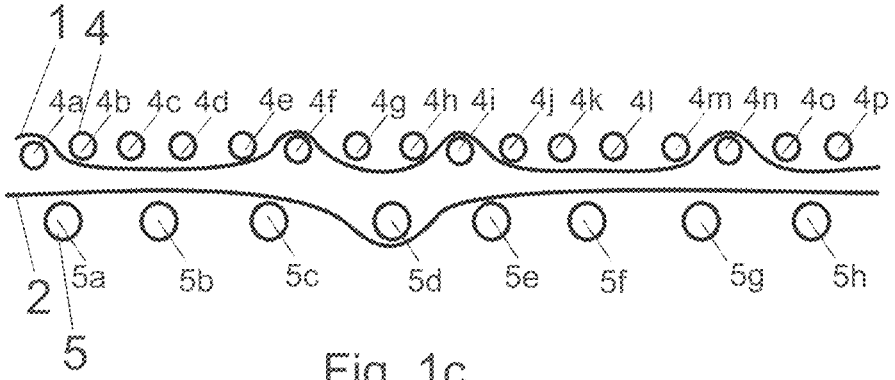

In FIG. 1*c* a first machine direction yarn 1 repeatedly passes over one first cross-machine direction yarns 4*a*, under four first cross-machine direction yarns 4*b*, 4*c*, 4*d*, 4*e*, over one first cross-machine direction yarn 4*f*, under two first cross-machine direction yarn 4*g*, 4*h*, over one first cross-machine direction yarns 4*i*, under four first cross-machine direction yarns 4*j*, 4*k*, 41, 4*m*, over one first cross-machine direction yarn 4*n* and under two first cross-machine direction yarns 4*o*, 4*p*.

In FIG. 1*c* a second machine direction yarn 2 repeatedly passes over three second cross-machine direction yarns 5*a*, 5*b*, 5*c*, under one second cross-machine direction yarn 5*d* and over four second cross-machine direction yarns 5*e*, 5*f*, 5*g*, 5*h*.

Figure 1D:
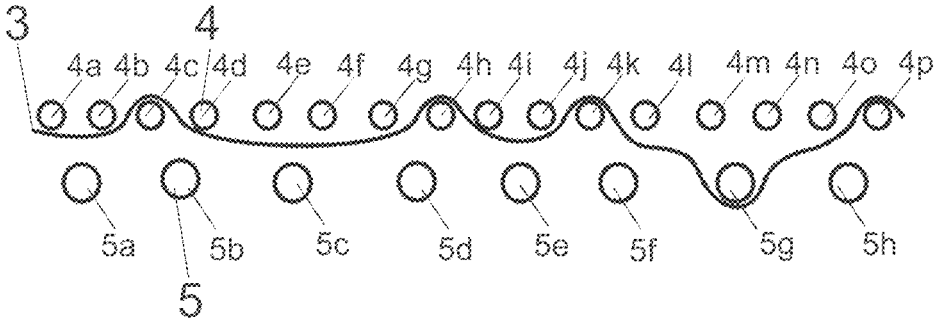

In FIG. 1*d* a third machine direction yarn 3 repeatedly passes under two first cross-machine direction yarn 4*a*, 4*b*, over one first cross-machine direction yarns 4*c*, under four first cross direction yarns 4*d*, 4*e*, 4*f*, 4*g*, over one first cross-machine direction yarn 4*h*, under two first cross-machine direction yarns 4*i*, 4*j*, over one first cross-machine direction yarn 4*k*, under four first cross-machine direction yarns 4*l*, 4*m*, 4*n*, 4*o* and over one first cross-machine direction yarns 4*p*.

When the third machine direction yarn 3 passes under the four first cross-machine direction yarns 4*l*, 4*m*, 4*n*, 4*o*, it also passes under one second cross-machine direction yarn 5*g*.

Figure 1E:
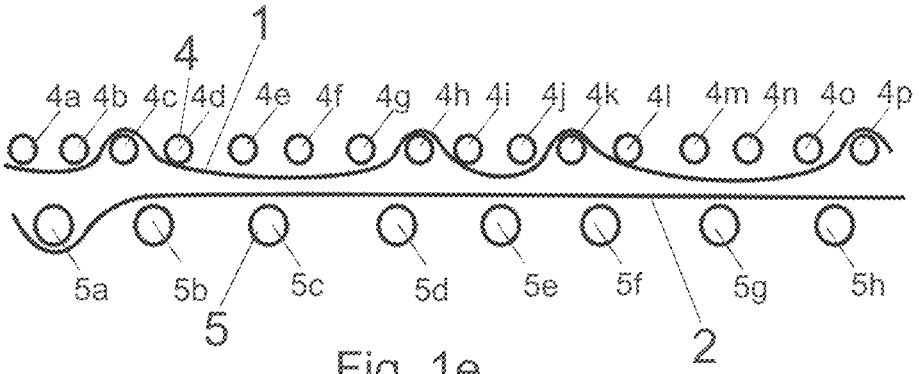

In FIG. 1*e* a first machine direction yarn 1 repeatedly passes under two first cross-machine direction yarns 4*a*, 4*b*, over one first cross-machine direction yarn 4*c*, under four first cross-machine direction yarn 4*d*, 4*e*, 4*f*, 4*g*, over one first cross-machine direction yarns 4*h*, under two first cross-machine direction yarns 4*i*, 4*j*, over one first cross-machine direction yarn 4*k*, under four first cross-machine direction yarns 4*l*, 4*m*, 4*n*, 4*o*, and over one first cross-machine direction yarns 4*p*.

In FIG. 1*e* a second machine direction yarn 2 repeatedly passes under one second cross-machine direction yarn 5*a* and over seven second cross-machine direction yarns 5*b*, 5*c*, 5*d*, 5*e*, 5*f*, 5*g*, 5*h*.

Figure 1F:
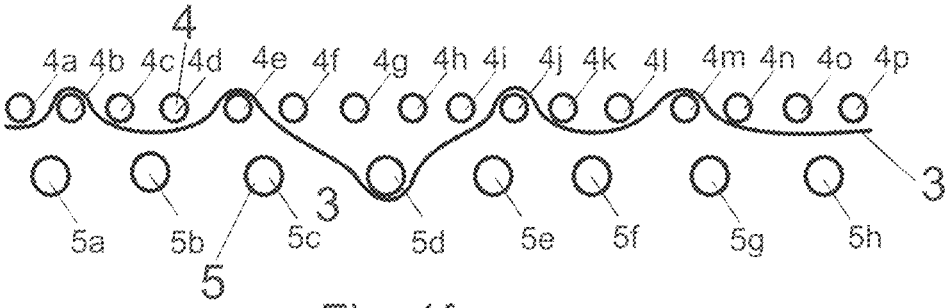

In FIG. 1*f* a third machine direction yarn 3 repeatedly passes under one first cross-machine direction yarn 4*a*, over one first cross-machine direction yarns 4*b*, under two first cross direction yarns 4*c*, 4*d*, over one first cross-machine direction yarn 4*e*, under four first cross-machine direction yarns 4*f*, 4*g*, 4*h*, 4*i*, over one first cross-machine direction yarn 4*j*, under two first cross-machine direction yarns 4*k*, 41, over one first cross-machine direction yarns 4*m* and under three first cross-machine direction yarns 4*n*, 4*o*, 4*p*.

When the third machine direction yarn 3 passes under the four first cross-machine direction yarns 4*f*, 4*g*, 4*h*, 4*i*, it also passes under one second cross-machine direction yarn 5*d*.

Figure 1G:
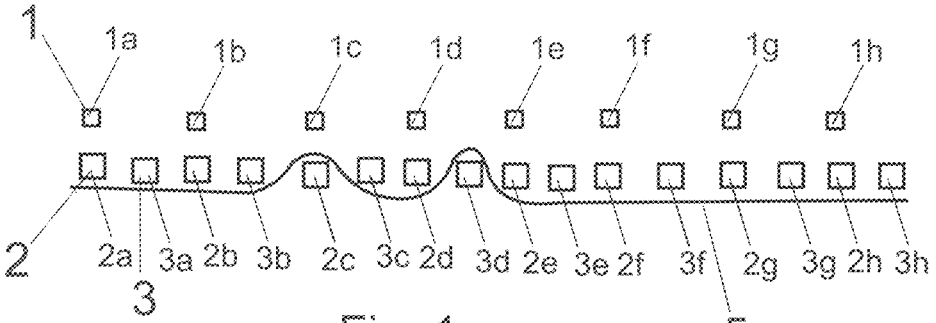

In FIG. 1*g* a second cross-machine direction yarn 5 passes under two second machine direction yarns 2*a*, 2*b* and under two third machine direction yarns 3*a*, 3*b*, over one second machine direction yarn 2*c*, under one third machine direction yarn 3*c* and one second machine direction yarn 2*d*, over one third machine direction yarn 3*d* and under second machine direction yarns 2*e*, 2*f*, 2*g*, 2*h* and third machine direction yarns 3*e*, 3*f*, 3*g*, 3*h*.

Figure 1H:
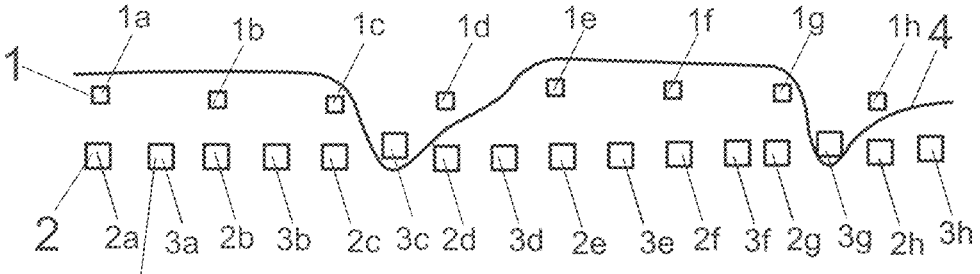

In FIG. 1*h* a first cross-machine direction yarn 4 repeatedly passes over three first machine direction yarns 1*a*, lb, 1*c*, under one first machine direction yarn 1*d*, over three first machine direction yarns 1*e*, 1*f*, 1*g* and under one first machine direction yarn 1*h*. When the first cross-machine direction yarn 4 passes under the first machine direction yarn 1*d*, 1*h* it also passes under one third machine direction yarn 3*c*, 3*g*.

The industrial textile 6 of FIGS. 1*a* to 1*h* has the weft ratio of 2:1.

FIGS. 1*b*, 1*d* and if show clearly that the third machine direction yarn 3 participates in forming the bind both on the front side 7 and the back side 8 of the industrial textile 6.

Figure 2:
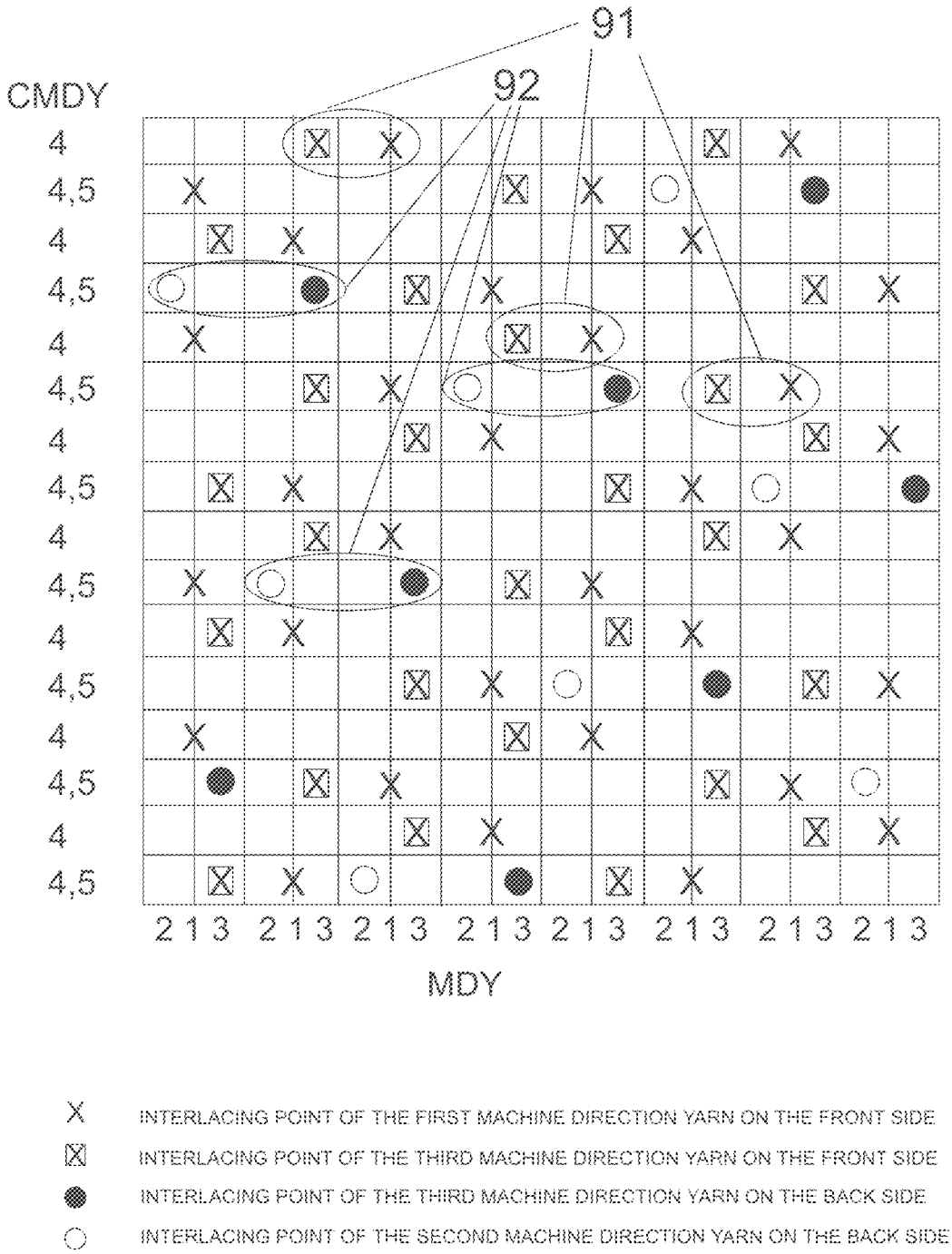
FIG. 2 shows the pattern of the industrial textile of FIGS. 1*a* to 1*h*.

FIG. 2 shows the whole pattern of FIGS. 1*a* to 1*h*. The cross-machine direction yarns CMDY, i.e. the first cross-machine direction yarns 4 and the second cross-machine direction yarns 5 are shown on the left side of FIG. 2. In other words, if there is number 4 alone it means that there is only the first cross-machine direction yarn 4 but if there are numbers 4, 5 it means that there are the first cross-machine direction yarns 4 and the second cross-machine direction yarns 5 on top of each other.

The machine direction yarns MDY, i.e. the first machine direction yarns 1, the second machine direction yarns 2 and the third machine direction yarns 3, are shown under FIG. 2.

The first machine direction yarns 1 and the first cross-machine direction yarns 4 form the front side of the industrial textile 6.

The second machine direction yarns 2 and the second cross-machine direction yarns 5 form the back side of the industrial textile 6.

The third machine direction yarns 3, the first cross-machine direction yarns 4 and the second cross-machine direction yarns 5 interweave the front side and the back side together.

The third machine direction yarns 3 and the first machine direction yarns 1 have common interlacing points 91 on the front side of the industrial textile 6. The whole surface of the industrial textile 6 is covered by the interlacing points 91. Examples of the interlacing points 91 are shown in FIG. 2.

The third machine direction yarns 3 and the second machine direction yarns 1 have common interlacing points 92 on the back side of the industrial textile 6. The whole surface of the industrial textile 6 is covered by the interlacing points 92. Examples of the interlacing points 92 are shown in FIG. 2.

Figure 3A:
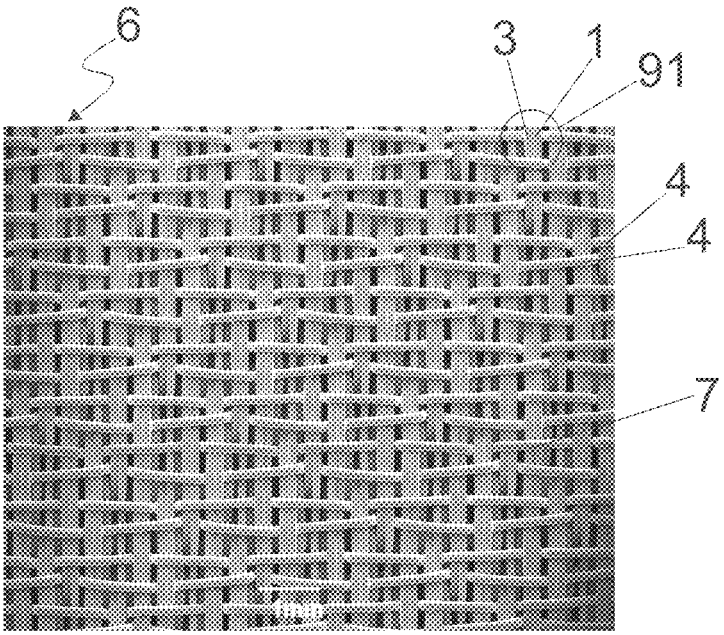
FIGS. 3*a* and 3*b* show micro photos of the industrial textile of FIGS. 1*a* to 1*h* and 2.
Figure 3B:
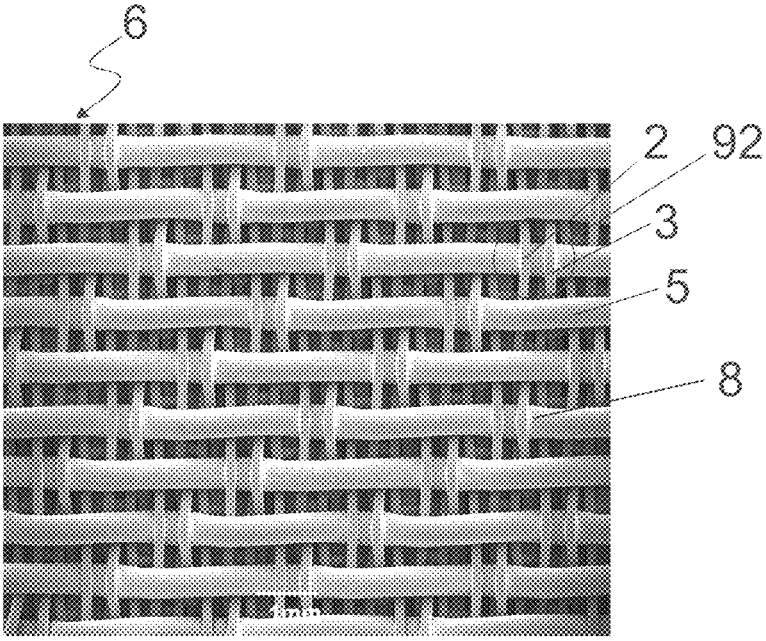

FIGS. 3*a* and 3*b* show micro photos of the industrial textile 6 of FIGS. 1*a* to 1*d* and 2. FIG. 3*a* shows the paper side of the industrial textile 6 comprising first machine direction yarns 1, third machine direction yarns 3 and first cross-machine direction yarns 4. An example of a common interlacing point 91 on the front side 7 of the industrial textile 6 is also shown.

FIG. 3*b* shows the machine side of the industrial textile 6 comprising second machine direction yarns 2, third machine direction yarns 3 and second cross-machine direction yarns 5. An example of a common interlacing point 92 on the back side 8 of the industrial textile 6 is also shown. The second machine direction yarns 2 and the third machine direction yarns 3 that form common interlacing points 92 are not necessarily adjacent but there may be a few machine direction yarns between the particular second machine direction yarn 2 and the particular third machine direction yarn 3 (as shown in FIG. 2).

The weft ratio of the industrial textile 6 of FIGS. 3*a* and 3*b* may be 2:1 (the ratio of the first cross-machine direction yarns 4 to the second cross-machine direction yarns 5), i.e., 2:1 means that there are double first cross-machine direction yarns 1 compared to the second cross-machine direction yarns 2.

Figures 4A, 4B:
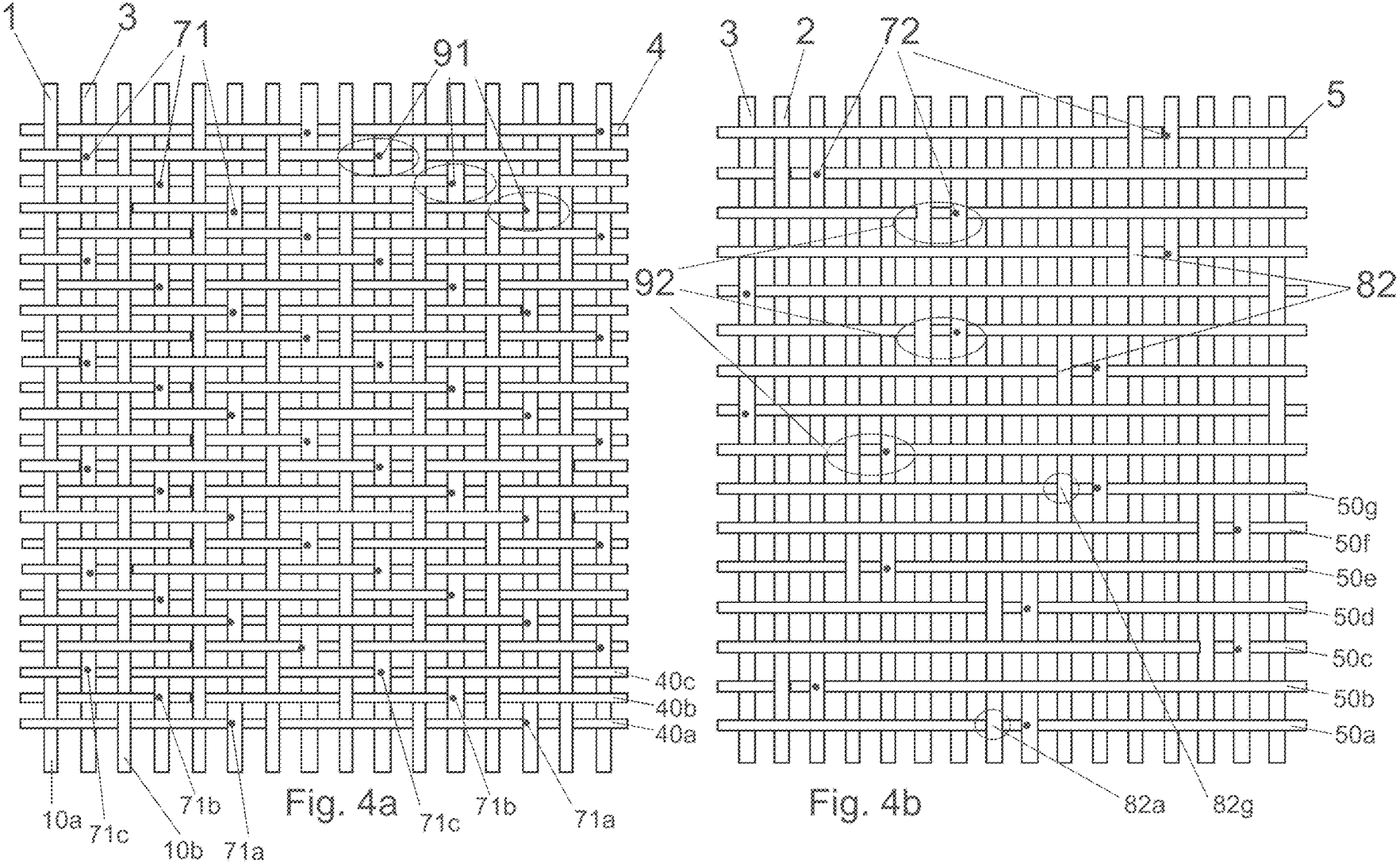
FIG. 4*a* shows a paper side structure of an industrial textile.
FIG. 4*b* shows a machine side structure of the industrial textile of FIG. 4*a*.

FIG. 4*a* shows a paper side structure of an industrial textile 6. First machine direction yarns 1 and first cross-machine direction yarns 4 form a plain weave. A first machine direction yarn 10*a* repeatedly passes below one cross-machine direction yarn 4 and passes above one successive cross-machine direction yarn 4. The first machine direction yarns 10*a*, 10*b* next to each other are arranged in such a manner that when a coincidentally selected first machine direction yarn 10*a* is under a first cross-machine direction yarn 4 a first machine direction yarn 10*b* next to the coincidentally selected first machine direction yarn 10*a* is above the first cross-machine direction yarn 4.

There are third machine direction yarns 3 between adjacent first machine direction yarns 10*a*, 10*b*, i.e., the first machine direction yarns 1 and the third machine direction yarn 3 alternate. A third machine direction yarn 3 repeatedly passes under three first cross-machine direction yarns 4 and above one first cross-machine direction yarn 4 on the paper side of the industrial textile 6.

The third machine direction yarns 3 have interlacing points 71 with the first cross-machine direction yarns 4 where a third machine direction yarn 3 passes over a first cross direction yarn 4. The interlacing points 71 cover the whole surface of the industrial textile 6 on the paper side of the industrial textile 6 (black dots in FIG. 4*a*).

The interlacing points 71 extend as parallel diagonal patterns over the paper side of the industrial textile 6. The interlacing points 71 between one first cross-machine direction yarn 4 and the third machine direction yarns 3 are offset compared to the interlacing points 71 that are above or below the particular first cross-machine direction yarn 4. For example, the first cross-machine direction yarn 40*b* has interlacing points 71*b* that are offset compared to interlacing points 71*a* or 71*c*. The offset may be ±1.

Examples of common interlacing points 91 on the front side of the industrial textile 6 are shown in FIG. 4*a*.

FIG. 4*b* shows a machine side structure of the industrial textile of FIG. 4*a* as it is seen from below. However, the structure is explained as it is seen from above (when it is under the paper side). Second machine direction yarns 2 and second cross-machine direction yarns 5 bind to each other in such a manner that a second machine direction yarn 2 passes over twelve second cross-machine direction yarns 5, under one cross-machine direction yarn 5, over two cross-machine direction yarns 5 and under one cross-machine direction yarn 5. The interlacing points 82 between one second cross-machine direction yarn 5 and the second machine direction yarns 3 are offset compared to the interlacing points 82 that are above or below the particular second cross-machine direction yarn 5. For example, the second cross-machine direction yarn 50*a* has an interlacing point 82*a* that is offset compared to an interlacing point 82*g*. The second pattern may have an offset of ±6.

A third machine direction yarn 3 repeatedly passes under one second cross-machine direction yarn 5, over two second cross-machine direction yarns 5, under one second cross-machine direction yarn 5 and over twelve second cross-machine direction yarns 5.

The third machine direction yarns 3 have interlacing points 72 with the second cross-machine direction yarns 5 where a third machine direction yarn 3 passes under a second cross-machine direction yarn 5. The interlacing points 72 cover the whole surface of the industrial textile 6 on the machine side of the industrial textile 6 (black dots in FIG. 4*b*). The third pattern may have an offset of ±6 on the machine side of the industrial textile 6.

The third machine direction yarns 3 are an integral part of the bind on the front and back side of the industrial textile 6, i.e. the bind of the front side and the bind of the back side are incomplete without the third machine direction yarns 3. FIGS. 4*a* and 4*b* show clearly that the third machine direction yarn 3 participates in forming the bind both on the front side 7 and the back side 8 of the industrial textile 6.

Examples of common interlacing points 92 on the front side of the industrial textile 6 are shown in FIG. 4*b*.

Figure 5A:
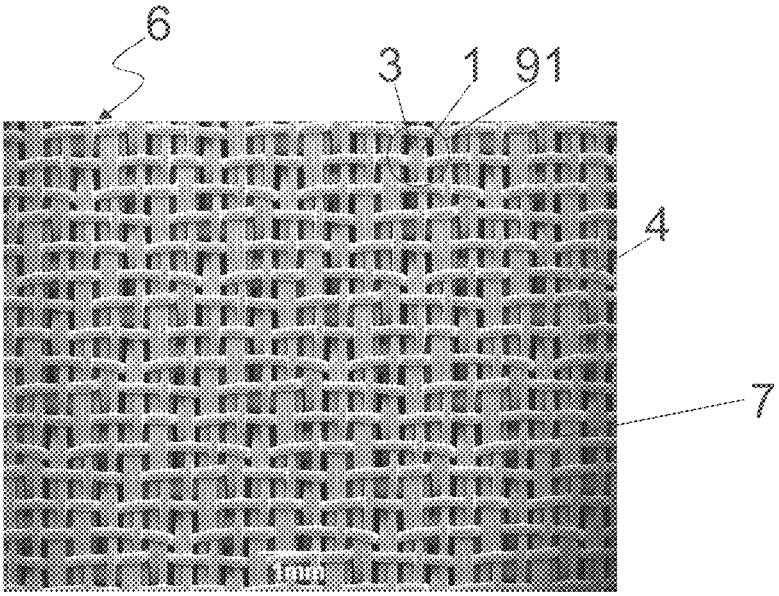
FIGS. 5*a* and 5*b* show micro photos about the industrial textile of FIGS. 4*a* and 4*b*.
Figure 5B:
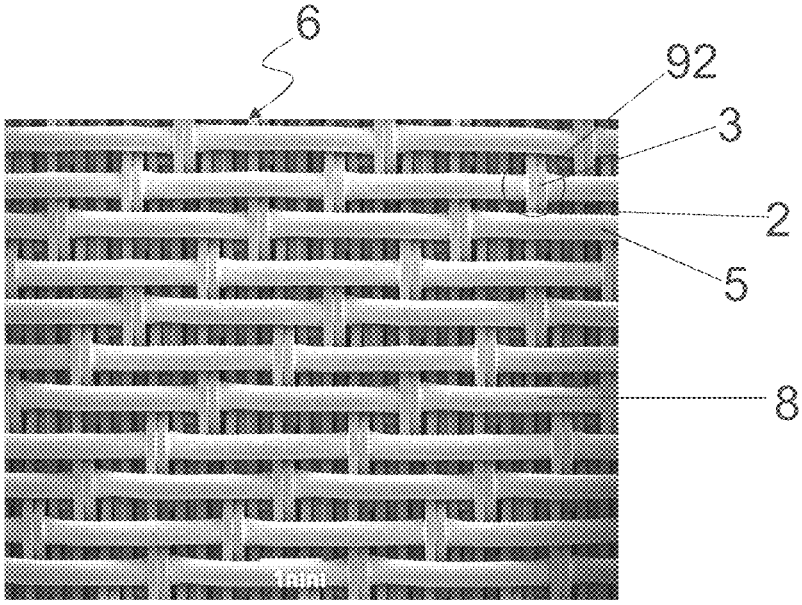

FIGS. 5*a* and 5*b* show micro photos of the industrial textile of FIGS. 4*a* and 4*b*. FIG. 5*a* shows the paper side of the industrial textile 6 comprising first machine direction yarns 1, third machine direction yarns 3 and first cross-machine direction yarns 4. An example of a common interlacing point 91 on the front side 7 of the industrial textile 6 is also shown in FIG. 5*a*.

FIG. 5*b* shows the machine side of the industrial textile 6 comprising second machine direction yarns 2, third machine direction yarns 3 and second cross-machine direction yarns 5. An example of a common interlacing point 92 on the back side 8 of the industrial textile 6 is also shown in FIG. 5*b*

The weft ratio of the industrial textile 6 of FIGS. 5*a* and 5*b* may be 3:2 (the ratio of the first cross-machine direction yarns 4 to the second cross-machine direction yarns 5).

Figure 6A:
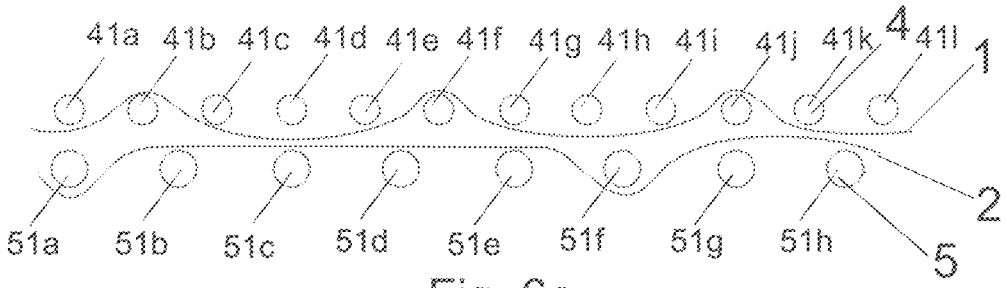
FIGS. 6*a* to 6*d* show a bind of an industrial textile.

FIGS. 6*a* to 6*d* show a bind of an industrial textile 6. A first machine direction yarn 1 repeatedly passes over one first cross-machine direction yarn 4 and under three first cross-machine direction yarns 4. In FIG. 6*a* the first machine direction yarn 1 passes under first cross direction yarn 41*a*, over one first cross direction yarn 41*b*, under three first cross direction yarns 41*c*, 41*d*, 41*e*, over one first cross-machine direction yarn 41*f*, under three first cross-machine direction yarns 41*g*, 41*h*, 41*i*, over one first cross-machine direction yarn 41*j* and under two first cross-machine direction yarn 41*k*, 41*l*.

In FIG. 6*a* a second machine direction yarn 2 repeatedly passes over four second cross-machine direction yarns 5 and under one second cross-machine direction yarn 5. In FIG. 6*a* the second machine direction yarn 2 passes under one second cross-machine direction yarn 51*a*, over four second cross-machine direction yarns 51*b*, 51*c*, 51*d*, 51*e*, under one second cross-machine direction yarn 51*f* and over two second cross-machine direction yarns 51*g*, 51*h*.

Figure 6B:
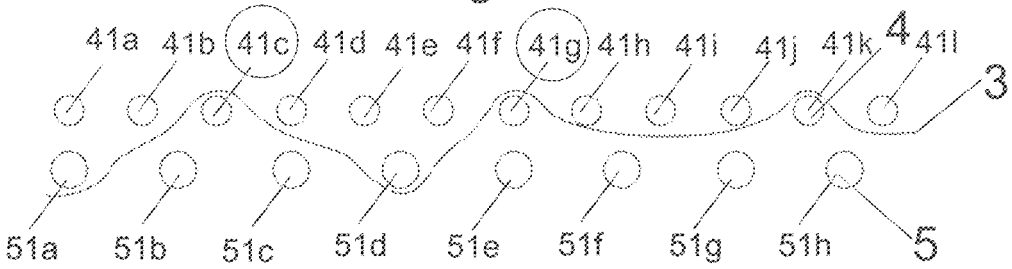

In FIG. 6*b* a third machine direction yarn 3 repeatedly passes under three first cross-machine direction yarns 4 and over one first cross direction yarn 4. When the third machine direction yarn 3 passes under the three first cross-machine direction yarns 5 it also passes under one second cross-machine direction yarn 5. In FIG. 6*b* the third machine direction yarn 3 passes under one second cross-machine direction yarn 51*a*, over one first cross-machine direction yarn 41*c*, under three first cross-machine direction yarns 41*d*, 41 *e*, 41*f* and one second cross-machine direction yarn 51*d*, over one first cross-machine direction yarn 41*g*, under three first cross-machine direction yarns 41*h*, 41*i*, 41*j*, over one first cross-machine direction yarn 41*k* and under one first cross-machine direction yarn 41*l*.

Figure 6C:
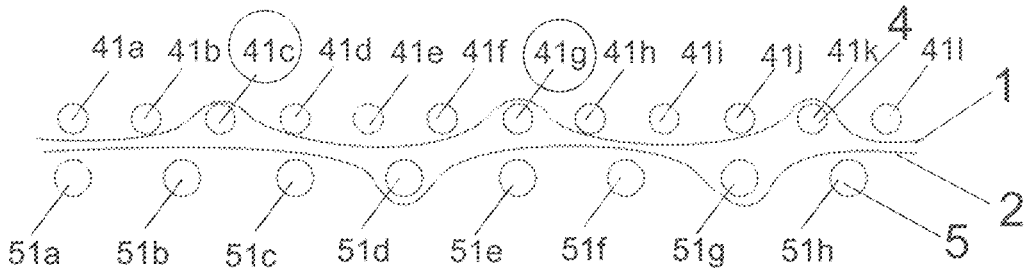

In FIG. 6*c* a first machine direction yarn 1 repeatedly passes over one first cross-machine direction yarn 4 and under three first cross-machine direction yarns 4. In FIG. 5*c* the first machine direction yarn 1 passes under two first cross direction yarns 41*a*, 41*b*, over one first cross direction yarn 41*c*, under three first cross direction yarns 41*d*, 41*e*, 41*f*, over one first cross-machine direction yarn 41*g*, under three first cross-machine direction yarns 41*h*, 41*i*, 41*j*, over one first cross-machine direction yarn 41*k* and under one first cross-machine direction yarn 41*l*.

In FIG. 6*c* a second machine direction yarn 2 repeatedly passes over four second cross-machine direction yarns 5, under one second cross-machine direction yarn 5, over two second cross-machine direction yarns 5 and under one second cross-machine direction yarn 5. In FIG. 5*c* the second machine direction yarn 2 passes over three second cross-machine direction yarns 51*a*, 51*b*, 51*c*, under one second cross-machine direction yarn 51*d*, over two second cross-machine direction yarns 51*e*, 51*f*, under one second cross-machine direction yarn 51*g* and over one second cross-machine direction yarn 51*h*.

Figure 6D:
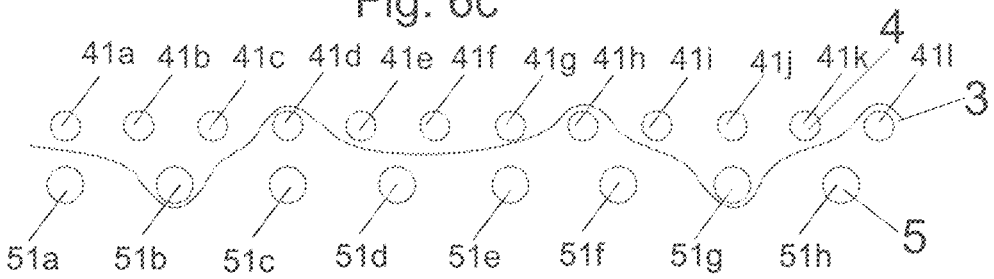

In FIG. 6*d* a third machine direction yarn 3 repeatedly passes under three first cross-machine direction yarns 4 and over one first cross direction yarn 4. Every other time when the third machine direction yarn 3 passes under the three first cross-machine direction yarns 5 it also passes under one second cross-machine direction yarn 5. In FIG. 5*d* the third machine direction yarn 3 passes under first cross-machine direction yarns 41*a*, 41*b*, 41*c* and under second cross-machine direction yarn 51*b*, over one first cross-machine direction yarn 41*d*, under three first cross-machine direction yarns 41*e*, 41*f*, 41*g*, over one first cross-machine direction yarn 41*h*, under three first cross-machine direction yarns 41*i*, 41*j*, 41*k* and one second cross-machine direction yarn 51*g* and over first cross-machine direction yarn 41*l*.

The third machine direction yarns 3 are an integral part of the bind on the front and back side of the industrial textile 6, i.e., the bind of the front side and the bind of the back side are incomplete without the third machine direction yarns 3. FIGS. 6*b*, 6*d*, 7*a* and 7*b* show clearly that the third machine direction yarn 3 participates in forming the bind both on the front side 7 and the back side 8 of the industrial textile 6.

Figure 7B:
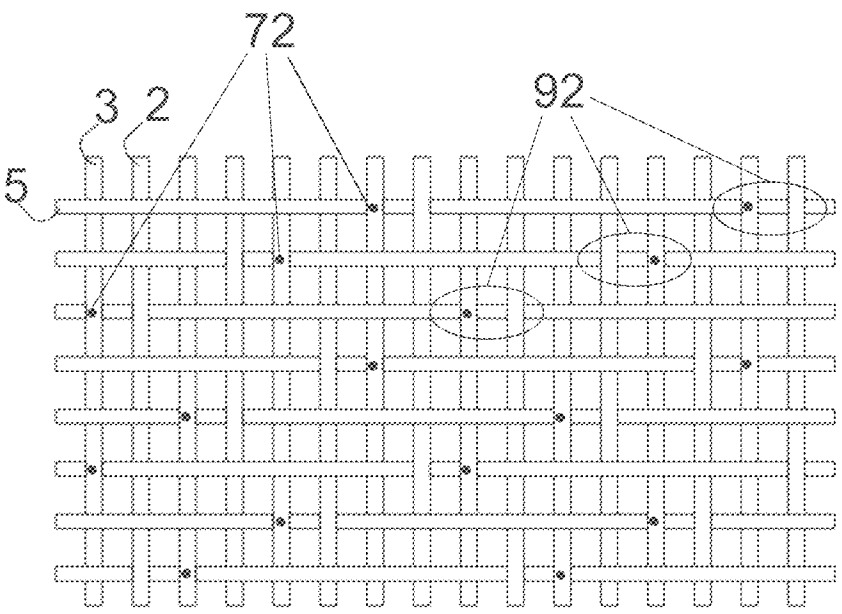
FIG. 7*b* shows a machine side structure of the industrial textile of FIGS. 6*a* to 6*d*.
Figure 7A:
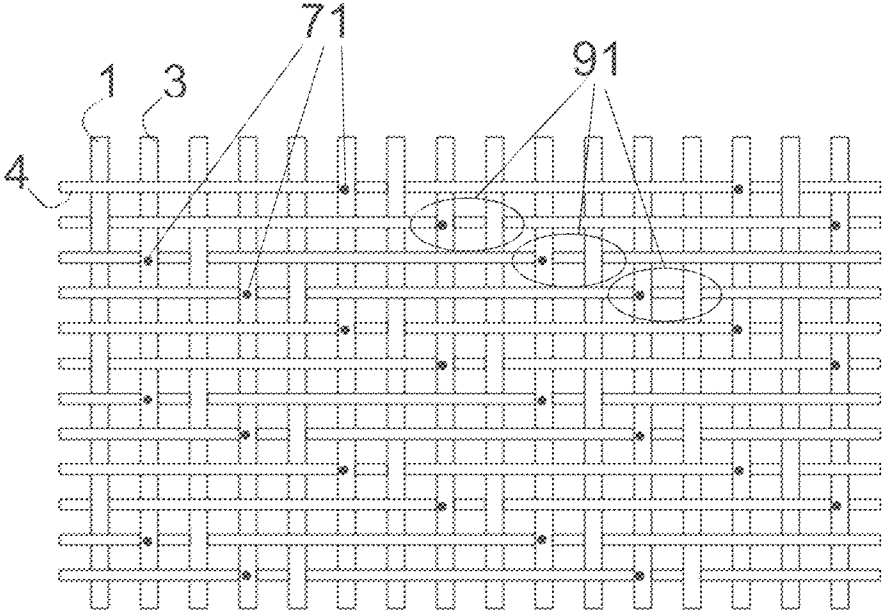
FIG. 7*a* shows the paper side structure of the industrial textile of FIGS. 6*a* to 6*d*.

FIG. 7*a* shows a paper side structure of the industrial textile 6 of FIGS. 6*a* to 6*d*. There are first machine direction yarns 1, third machine direction yarns 3 and first cross-machine direction yarns 4. The first pattern comprises the first machine direction yarns 1 and the first cross-machine direction yarns 4 which are configured in the following manner: Each first machine direction yarn 1 passes below three first cross-machine direction yarns 4 and over one first machine direction yarn 4. The first pattern has an offset of ±1.

There are third machine direction yarns 3 between adjacent first machine direction yarns 1. Each third machine direction yarn 3 repeatedly passes under three first cross-machine direction yarns 4 and over one first cross-machine direction yarn 4.

The third machine direction yarns 3 have interlacing points 71 with the first cross-machine direction yarns 4 where a third machine direction yarn 3 passes over a first cross direction yarn 4. The interlacing points 71 cover the whole surface of the industrial textile 6 on the paper side of the industrial textile 6.

Examples of common interlacing points 91 on the front side 7 of the industrial textile 6 are shown in FIG. 7*a*.

FIG. 7*b* shows a machine side structure of the industrial textile of FIG. 7*a* as it is seen from below. However, the structure is explained as it is seen from above (when it is under the paper side).

The second pattern comprises the second machine direction yarns 2 and the second cross-machine direction yarns 5 which are configured in the following manner: Each second machine direction yarn 2 passes under one second cross-machine direction yarn 5, over four second cross-machine direction yarns 5, under one cross-machine direction yarn 5 and over two second cross-machine direction yarns 5. The second pattern has an offset of ±2.

The third machine direction yarns 3 have interlacing points 72 with the second cross-machine direction yarns 5 where a third machine direction yarn 3 passes over a second cross direction yarn 5. The interlacing points 72 cover the whole surface of the industrial textile 6 on the paper side of the industrial textile 6.

Examples of common interlacing points 92 on the front side 7 of the industrial textile 6 are shown in FIG. 7*b*.

Figure 8A:
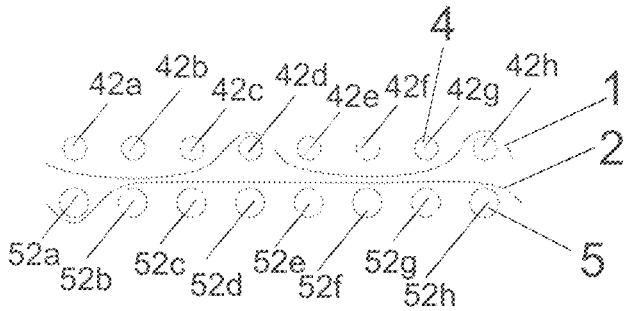
FIGS. 8*a* to 8*f* show a bind of an industrial textile.

FIGS. 8*a* to 8*f* show a bind of the industrial textile 6. In FIG. 8*a* a first machine direction yarn 1 passes under three first cross-machine direction yarns 42*a*, 42*b*, 42*c*, over one first cross-machine direction yarn 42*d*, under three first cross-machine direction yarns 42*e*, 42*f*, 42*g* and over one first cross-machine direction yarn 42*h*.

A second machine direction yarn 2 passes under one second cross-machine direction yarn 52*a* and over seven second cross-machine yarns 52*b*, 52*c*, 52*d*, 52*e*, 52*f*, 52*g*, 52*h*.

Figure 8B:
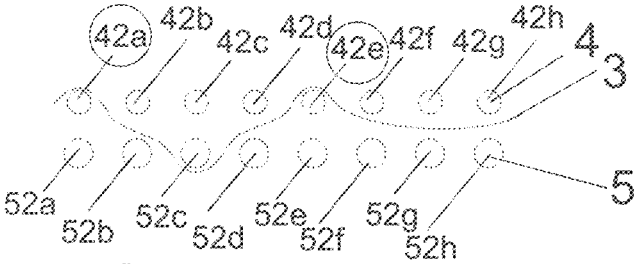

In FIG. 8*b* a third machine direction yarn 3 passes over one first cross-machine direction yarn 42*a*, under three first cross-machine direction yarns 42*b*, 42*c*, 42*d* and one second cross-machine direction yarn 52*c*, over one first cross-machine direction yarn 42*e* and under three first cross-machine direction yarns 42*f*, 42*g*, 42*h*.

Figure 8C:
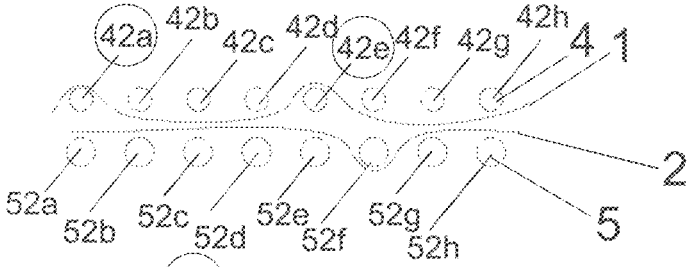

In FIG. 8*c* a first machine direction yarn 1 passes over one first cross-machine direction yarn 42*a*, under three first cross-machine direction yarns 42*b*, 42*c*, 42*d*, over one first cross-machine direction yarn 42*e* and under three first cross-machine direction yarns 42*f*, 42*g*, 42*h*.

A second machine direction yarn 2 passes over five second cross-machine yarns 52*a*, 52*b*, 52*c*, 52*d*, 52*e*, under one second cross-machine direction yarn 52*f* and over two second cross-machine direction yarns 52*g*, 52*h*.

Figure 8D:
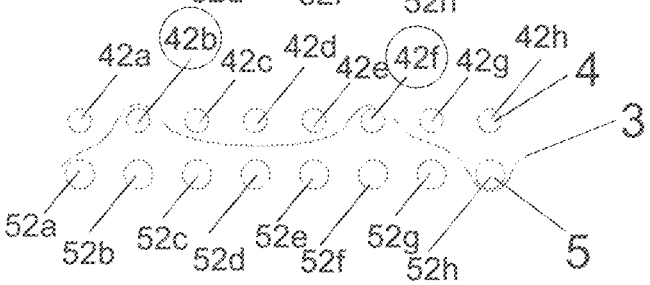

In FIG. 8*d* a third machine direction yarn 3 passes under one first cross-machine direction yarn 42*a*, over one first cross-machine direction yarn 42*b*, under three first cross-machine direction yarns 42*c*, 42*d*, 42*e*, over one first cross-machine direction yarn 42*f*, under two first cross-machine direction yarns 42*g*, 42*h* and one second cross-machine direction yarn 52*h*.

Figure 8E:
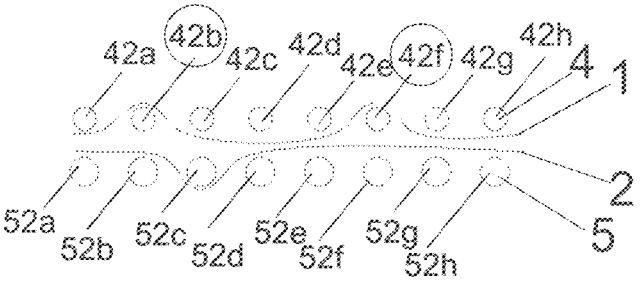

In FIG. 8*e* a first machine direction yarn 1 passes under one first cross-machine direction yarn 42*a*, over one first cross-machine direction yarn 42*b*, under three first cross-machine direction yarns 42*c*, 42*d*, 42*e*, over one first cross-machine direction yarn 42*f* and under two first cross-machine direction yarns 42*g*, 42*h*.

A second machine direction yarn 2 passes over two second cross-machine yarns 52*a*, 52*b*, under one second cross-machine direction yarn 52*c* and over five second cross-machine direction yarns 52*d*, 52*e*, 52*f*, 52*g*, 52*h*.

Figure 8F:
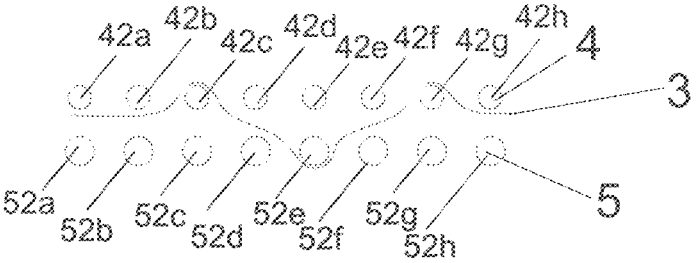

In FIG. 8*f* a third machine direction yarn 3 passes under two first cross-machine direction yarns 42*a*, 42*b*, over one first cross-machine direction yarn 42*c*, under three first cross-machine direction yarns 42*d*, 42*e*, 42*f* and one second cross-machine direction yarn 52*e*, over one first cross-machine direction yarn 42*g* and under one first cross-machine direction yarn 42*h*.

The third machine direction yarns 3 are an integral part of the bind on the front and back side of the industrial textile 6, i.e., the bind of the front side and the bind of the back side are incomplete without the third machine direction yarns 3. FIGS. 8*b*, 8*d*, 8*f*, 9*a* and 9*b* show clearly that the third machine direction yarn 3 participates in forming the bind both on the front side 7 and the back side 8 of the industrial textile 6. FIG. 9*a* shows the paper side structure of the industrial textile 6 of FIGS. 8*a* to 8*f*. The third machine direction yarns 3 have interlacing points 71 with the first cross-machine direction yarns 4 where a third machine direction yarn 3 passes over a first cross direction yarn 4. The interlacing points 71 cover the whole surface of the industrial textile 6 on the paper side of the industrial textile 6.

Examples of common interlacing points 91 on the front side 7 of the industrial textile 6 are shown in FIG. 9*a*.

Figure 9B:
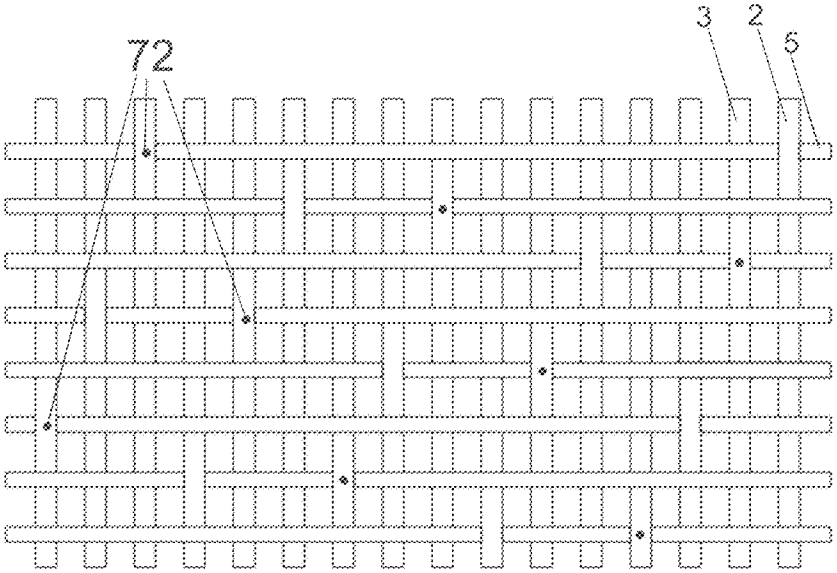
FIG. 9*b* shows the machine side structure of the industrial textile of FIGS. 8*a* to 8*f*.
Figure 9A:
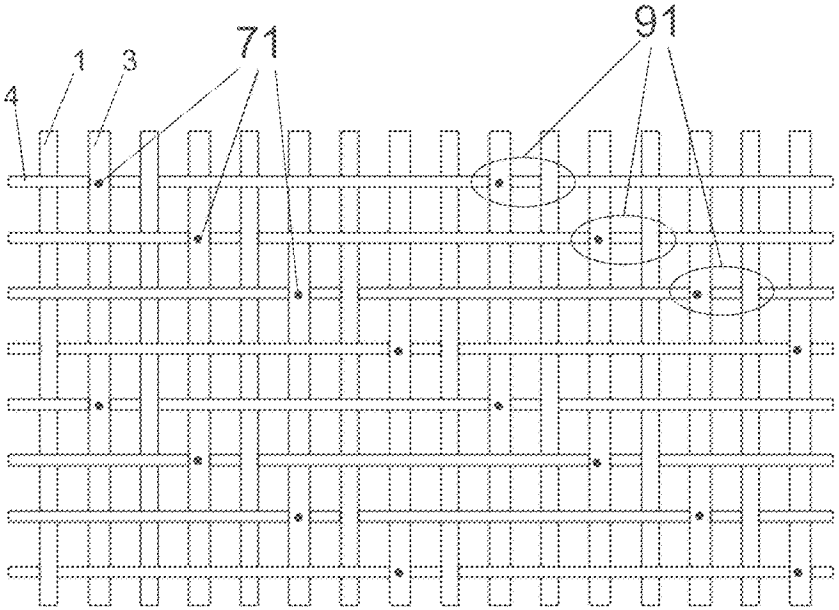
FIG. 9*a* shows the paper side structure of the industrial textile of FIGS. 8*a* to 8*f*.

FIG. 9*b* shows the machine side structure of the industrial textile of FIG. 9*a*. The third machine direction yarns 3 have interlacing points 72 with the second cross-machine direction yarns 5 where a third machine direction yarn 3 passes under a second cross-machine direction yarn 5. The interlacing points 72 cover the whole surface of the industrial textile 6 on the machine side of the industrial textile 6 (black dots in FIG. 7*b*).

FIG. 9*c* shows illustratively that the third machine direction yarns 3 are an integral part of the bind on the front and back side of the industrial textile 6, i.e. the bind of the front side and the bind of the back side are incomplete without the third machine direction yarns 3.

It will be obvious to a person skilled in the art that, as the technology advances, the inventive concept can be implemented in various ways. The invention and its embodiments are not limited to the examples described above but may vary within the scope of the claims.

It should be understood that a bind means the structural arrangement of yarns in a woven fabric. A bind (of an industrial textile) is the arrangement of warp and weft yarns which form a fabric.

We claim:

1. An industrial textile (6) for manufacturing a fibrous web, the industrial textile (6) having a front side (7) and a back side (8), the industrial textile (6) having a bind and comprising:

first machine direction yarns (1), second machine direction yarns (2), third machine direction yarns (3), first cross-machine direction yarns (4), second cross-machine direction yarns (5), wherein the first machine direction yarns (1) on the front side (7) of the industrial textile (6) bind to the first cross-machine direction yarns (4) according to a first pattern, the second machine direction yarns (2) on the back side of the industrial textile bind to the second cross-machine direction yarns (5) according to a second pattern, the third machine direction yarns (3) bind to the first cross-machine direction yarns (4) and the second cross-machine direction yarns (5) according to a third pattern, the third machine direction yarns (3) are configured to extend side by side with the first machine direction yarns (1) on the front side (7) of the industrial textile (6) and form an integral part of the bind, the third pattern comprises interlacing points (71) on the front side (7) of the industrial textile (6), the interlacing point (71) is configured to form when one of the third machine direction yarns (3) is configured to pass over one of the first cross-machine direction yarns (4), the third pattern comprises interlacing points (72) on the back side (8) of the industrial textile (6), the interlacing point (72) is configured to form when the same third machine direction yarn (3), which is configured to pass over the first cross-machine direction yarn (4), is configured to pass under one of the second cross-machine direction yarns (5), a common interlacing point (91) is configured to form when a first machine direction yarn (1), which is adjacent to the third machine direction yarn (3) that is configured to pass over one of the first cross-machine direction yarns (4), under the preceding first cross-machine direction yarn (4) and under the following first cross-direction yarn (4) on the front side (7) of the industrial textile (6), is configured to pass over the same first cross-machine direction yarn (4) as the third machine direction yarn (3), under the preceding first cross-machine direction yarn (4) and under the following first cross-direction yarn (4), and the common interlacing point (91) is configured to form at least twice within the second pattern.

2. The industrial textile of claim 1, wherein the first pattern comprises the first machine direction yarns (1) and the first cross-machine direction yarns (4) which are configured in the following manner: Each first machine direction yarn (1) repeatedly passes under one first cross-machine direction yarn (4) and over one first cross-machine direction yarn (4), the first machine direction yarns (1) next to each other are arranged in such a manner that when a coincidentally selected first machine direction yarn (1) is under a first cross-machine direction yarn (4) a first machine direction yarn (1) next to the coincidentally selected first machine direction yarn (1) is above the first cross-machine direction yarn (4).

3. The industrial textile of claim 1, wherein the second pattern comprises the second machine direction yarns (2) and second cross-machine direction yarns (5) which are configured in the following manner: Each second machine direction yarn (2) repeatedly passes over twelve second cross-machine direction yarns (5), under one second cross-machine direction yarn (5), over two second machine direction yarns (5) and under one second cross-machine direction yarn (5), the second pattern having an offset of ±6.

4. The industrial textile of claim 1, wherein the third pattern comprises the third machine direction yarns (3), the first cross-machine direction yarns (4) and the second cross-machine direction yarns (5) which are configured in the following manner: Each third machine direction yarn (3) passes under three first cross-machine direction yarns (4) and over one first cross-machine direction yarn (4) on the paper side of the industrial textile and it passes under one second cross-machine direction yarn (5) on the machine side every second time when it passes under three first cross-machine direction yarns (4).

5. The industrial textile of claim 1, wherein the ratio of the first cross-machine direction yarns (4) to the second cross-machine direction yarns (5) is 3:2.

6. The industrial textile of claim 1, wherein the first pattern comprises the first machine direction yarns (1) and the first cross-machine direction yarns (4) which are configured in the following manner: Each first machine direction yarn (1) passes below three first cross-machine direction yarns (4) and over one first machine direction yarn (4), the first pattern having an offset of ±1.

7. The industrial textile of claim 6, wherein the second pattern comprises the second machine direction yarns (2) and the second cross-machine direction yarns (5) which are configured in the following manner: Each second machine direction yarn (2) passes under one second cross-machine direction yarn (5), over four second cross-machine direction yarns (5), under one cross-machine direction yarn (5) and over two second cross-machine direction yarns (5), the second pattern having an offset of ±1.

8. The industrial textile of claim 6, wherein the third pattern comprises the third machine direction yarns (3), the first cross-machine direction yarns (4) and the second cross-machine direction yarns (5) which are configured in the following manner: Each third machine direction yarn (3) passes under three first cross-machine direction yarns (4) and over one first cross-machine direction yarn (4) and it passes under one second cross-machine direction yarn (5) every second time when it passes under three first cross-machine direction yarns (4).

9. The industrial textile of claim 8, wherein the ratio of the first cross-machine direction yarns (4) to the second cross-machine direction yarns (5) is 3:2.

10. The industrial textile of claim 7, wherein the second pattern comprises second machine direction yarns (2) and second cross-machine direction yarns (5) which are configured in the following manner: Each second machine direction yarn (2) passes under one second cross-machine direction yarn (5) and over seven second cross-machine direction yarns, the second pattern having an offset of ±5.

11. The industrial textile of claim 7, wherein the third pattern comprises the third machine direction yarns (3), the first cross-machine direction yarns (4) and the second cross-machine direction yarns (5) which are configured in the following manner: Each third machine direction yarn (3) passes under three first cross-machine direction yarns (4) and over one first cross-machine direction yarn (4) and it passes under one second cross-machine direction yarn (5) every second time when it passes under three first cross-machine direction yarns (4).

12. The industrial textile of claim 7, wherein the ratio of the first cross-machine direction yarns (4) to the second cross-machine direction yarns (5) is 1:1.

13. The industrial textile of claim 1, wherein the first pattern comprises first machine direction yarns (1) and first cross machine direction yarns (4) which are configured in the following manner: Each first machine direction yarn (1) passes over one first cross-machine direction yarn (4), under two first cross-machine direction yarns (4), over one first cross-machine direction yarns (4) and under four first cross-machine direction yarns (4).

14. The industrial textile of claim 13, wherein the second pattern comprises second machine direction yarns (2) and second cross-machine direction yarns (5) which are configured in the following manner: Each second machine direction yarn (2) passes under one second cross-machine direction yarn (5) and over seven second cross-machine direction yarns (5).

15. The industrial textile of claim 13, wherein the third pattern comprises third machine direction yarns (3), first cross-machine direction yarns (4) and second cross-machine direction yarns (5) which are configured in the following manner: Each third machine direction yarn (3) passes under four first cross-machine direction yarns (4), over one first cross-machine direction yarn (4), under two cross-machine direction yarns (4) and over one first cross-machine direction yarn (4) and it passes under one second cross-machine direction yarn (5) every second time when it passes under four first cross-machine direction yarns (4).

16. The industrial textile of claim 13, wherein the second cross-machine direction yarn (5) passes under two second machine direction yarns (2) and under two third machine direction yarns (3), over one second cross-machine direction yarn (2), under one third machine direction yarn (1) and one second machine direction yarn (2), over one third machine direction yarn (3), under four second machine direction yarns (2) and under four third machine direction yarns (3).

17. The industrial textile of claim 13, wherein the first cross-machine direction yarn (4) passes over three first machine direction yarns (1) and under one first machine direction yarn (1) and it passes under one third machine direction yarn (3) when it passes one first machine direction yarn (1).

18. The industrial textile of claim 13, wherein the ratio of the first cross-machine direction yarns (4) to the second cross-machine direction yarns (5) is 2:1.

19. The industrial textile of claim 1, wherein a common interlacing point (92) is configured to form when a second machine direction yarn (2), which is adjacent to the third machine direction yarn (3) that is configured to pass under one of the second cross-machine direction yarns (5) on the back side (8) of the industrial textile (6), is configured to pass under the same second cross-machine direction yarn (5) as the third machine direction yarn (3).

20. The industrial textile of claim 1, wherein a second machine direction yarn (2) is in a vicinity of a third machine direction yarn (3) in such a manner that there is at least one machine direction yarn between the second machine direction yarn (2) and the third machine direction yarn (3) and a common interlacing point (92) is configured to form when the second machine direction yarn (2) that is configured to pass under one of the second cross-machine direction yarns (5) on the back side (8) of the industrial textile (6), is configured to pass under the same second cross-machine direction yarn (5) as the third machine direction yarn (3).

* * * * *